US009074156B2

(12) United States Patent
Brossaud

(10) Patent No.: US 9,074,156 B2
(45) Date of Patent: Jul. 7, 2015

(54) PROCESS FOR THE MANUFACTURE OF A GREASE COMPOSITION

(75) Inventor: Jean-Luc Pierre André Brossaud, Houppeville (FR)

(73) Assignee: Shell Oil Company, Houston, TX (US)

( * ) Notice: Subject to any disclaimer, the term of this patent is extended or adjusted under 35 U.S.C. 154(b) by 174 days.

(21) Appl. No.: 13/808,013

(22) PCT Filed: Jul. 1, 2011

(86) PCT No.: PCT/EP2011/061097

§ 371 (c)(1), (2), (4) Date: Mar. 5, 2013

(87) PCT Pub. No.: WO2012/004198

PCT Pub. Date: Jan. 12, 2012

(65) Prior Publication Data

US 2013/0157907 A1 Jun. 20, 2013

(30) Foreign Application Priority Data

Jul. 5, 2010 (EP) ..... 10305738

(51) Int. Cl.

| | |
|---|---|
| ***C10M 173/02*** | (2006.01) |
| ***B01F 17/00*** | (2006.01) |
| ***C10M 169/00*** | (2006.01) |
| ***C10M 129/28*** | (2006.01) |
| ***C10M 113/00*** | (2006.01) |
| ***C10M 117/02*** | (2006.01) |
| ***C10M 117/04*** | (2006.01) |
| ***C10M 117/06*** | (2006.01) |
| ***C10M 117/08*** | (2006.01) |
| ***C10M 177/00*** | (2006.01) |
| ***C10M 125/10*** | (2006.01) |

(52) U.S. Cl.

CPC ..... *C10M 129/28* (2013.01); *C10M 113/00* (2013.01); *C10M 117/02* (2013.01); *C10M 117/04* (2013.01); *C10M 117/06* (2013.01); *C10M 117/08* (2013.01); *C10M 177/00* (2013.01); *C10M 2201/087* (2013.01); *C10M 2201/0876* (2013.01); *C10M 2207/122* (2013.01); *C10M 2207/1225* (2013.01); *C10M 2207/123* (2013.01); *C10M 2207/1236* (2013.01); *C10M 2207/124* (2013.01); *C10M 2207/1265* (2013.01); *C10M 2207/127* (2013.01); *C10M 2207/1276* (2013.01); *C10M 2207/128* (2013.01); *C10M 2207/1285* (2013.01); *C10M 2207/141* (2013.01); *C10M 2207/1415* (2013.01); *C10N 2210/01* (2013.01); *C10N 2210/02* (2013.01); *C10N 2210/03* (2013.01); *C10N 2210/04* (2013.01); *C10N 2220/08* (2013.01); *C10N 2230/06* (2013.01); *C10N 2240/02* (2013.01); *C10N 2240/04* (2013.01); *C10N 2250/10* (2013.01); *C10N 2270/00* (2013.01); *C10M 125/10* (2013.01)

(58) Field of Classification Search

CPC ..... C10M 2201/087; C10M 2201/062; C10M 2207/125; C10N 2210/04

USPC ..... 508/158, 172, 165, 178

See application file for complete search history.

(56) References Cited

U.S. PATENT DOCUMENTS

| | | | | |
|---|---|---|---|---|
| 5,650,380 | A * | 7/1997 | Fletcher | 508/168 |
| 5,744,539 | A * | 4/1998 | McCoy et al. | 524/546 |
| 2009/0062165 | A1 * | 3/2009 | Denis et al. | 508/172 |

FOREIGN PATENT DOCUMENTS

| | | |
|---|---|---|
| CN | 87105053 | 2/1988 |
| CN | 101481637 | 7/2009 |
| EP | 2075314 | 1/2009 |

* cited by examiner

*Primary Examiner* — Vishal Vasisth

(57) ABSTRACT

Processes for the manufacture of metal complex grease compositions are provided. In one embodiment, the process comprises: preparing a slurry comprising a base oil, water, a metal base and a complexing agent, wherein the weight ratio of water:solid in the slurry is in the range of from 0.15:1 to 1.5:1; applying shear to the slurry; adding a $C_{10}$-$C_{24}$ saturated or unsaturated fatty acid or derivative thereof to effect a saponification reaction; removing water from the saponified product; heating the saponified product at a temperature in the range of from 190 to 230° C.; and subsequently cooling the product to a temperature in the range of from 200 to 150° C. to form the metal complex grease composition.

11 Claims, No Drawings

PROCESS FOR THE MANUFACTURE OF A GREASE COMPOSITION

This application is a 371 of PCT/EP11/61097, filed Jul. 1, 2011.

PRIORITY CLAIM

The present application claims priority from PCT/EP2011/061097, filed 1 Jul. 2011, which claims priority from European patent application 10305738.6, filed 5 Jul. 2010, which is incorporated herein by reference.

FIELD OF THE INVENTION

The present invention relates to a process for manufacturing a lubricating grease composition, and to lubricating grease compositions manufactured according the process.

BACKGROUND OF THE INVENTION

The primary purpose of lubrication is separation of solid surfaces moving relative to one another, to minimise friction and wear. The materials most frequently used for this purpose are oils and greases. The choice of lubricant is mostly determined by the particular application.

Lubricating greases are employed where high contact stresses exist, where lubricant leakage from the bearings is undesirable or where the motion of the contacting surfaces is discontinuous so that it is difficult to maintain a separating film in the bearing. Because of design simplicity, decreased sealing requirements and less need for maintenance, greases are almost universally given first consideration for lubricating ball and roller bearings in electric motors, household appliances, automotive wheel bearings, machine tools or aircraft accessories. Greases are also used for the lubrication of small gear drives and for many slow-speed sliding applications.

Lubricating greases consist primarily of a fluid lubricant, such as an oil, and a thickener, typically together with one or more performance additives. Essentially, the same type of oil is employed in compounding a grease as would normally be selected for oil lubrication. Fatty acid soaps of lithium, calcium, sodium, aluminium and barium are commonly used as thickeners. Fatty acid complex soaps are also well known as grease thickeners.

While much is known about the manufacturing processes of lubricating grease compositions, there is a continuing need for improvement so that productivity is maximized and cost is minimized. In particular, reduction of batch times leads to an increase in productivity and reduced cost. There is also a continual need for improving the energy efficiency of grease manufacturing processes.

In the preparation of a grease, for example, a lithium grease, it is required to add a certain amount of water with the raw materials to promote the efficiency of the saponification reaction. The added water reduced the product viscosity in the reactor, helps mixing, increases the reaction at the water/oil interface between raw materials and therefore promotes the chemical reaction. To obtain the correct grease properties, the water must then be removed typically by evaporation in a so-called "venting step". This venting step is time consuming and energy demanding, particularly in the case of lithium complex greases that contain more solid ingredients and hence need more water. In addition, the higher consistency of lithium complex greases makes the removal of water even more difficult. It would therefore be advantageous to develop a manufacturing process for metal complex greases wherein the amount of water is reduced and the venting time is shortened.

It has now surprisingly been found that by reducing the particle size of the solid components used to make a metal complex grease, e.g. metal base and complexing agent, significantly less water is needed to achieve the saponification reaction, and therefore the venting time is shortened and the grease plant productivity is increased.

SUMMARY OF THE INVENTION

According to the present invention there is provided a process for the manufacture of a metal complex grease composition comprising the steps of:

(i) preparing a slurry comprising base oil, water, metal base and complexing agent, wherein the weight ratio of water: solid in the slurry is in the range of from 0.15:1 to 1.5:1;

(ii) applying shear to the slurry at a shear frequency of at least 1,000,000 $s^{-1}$;

(iii) adding the slurry emerging from step (ii) to a $C_{10}$-$C_{24}$ saturated or unsaturated fatty acid or derivative thereof to effect a saponification reaction, the saponification reaction being carried out at a temperature of at least 80° C.;

(iv) removing water from the saponified product resulting from step (iii);

(v) heating the product emerging from step (iv) to a temperature of at least 190° C.; and (vi) cooling the product emerging from step (v) to a temperature in the range of 200 to 150° C. to form a metal complex grease composition.

According to the present invention there is further provided a lubricating grease composition prepared by the process described herein.

It has surprisingly been found that the process of the present invention provides a reduction in the venting time required to evaporate the water, a reduction in overall batch time, a more energy efficient manufacturing process and an increase in productivity.

DETAILED DESCRIPTION OF THE INVENTION

A first essential step of the process of the present invention involves the preparation of a slurry comprising base oil, water, metal base and complexing agent.

The slurry is prepared in a dedicated slurry tank. This slurry tank is a vessel where solids (e.g. lithium hydroxide, boric acid, calcium hydroxide, salicylic acid, etc.) and liquids (water, base oil(s), additives, etc.) are added together to prepare a dispersion or "suspension" prior to transfer to an autoclave.

There are no particular limitations regarding the base oil used in the process of the present invention, and various conventional mineral oils and synthetic oils may be conveniently used. For the purpose of this description, the term "base oil" is meant to also include a grease base stock.

Preferably, the lubricating composition comprises at least 30 wt. % base oil, preferably at least 50 wt. %, more preferably at least 70 wt. %, based on the total weight of the lubricating composition.

The base oil composition used in the present invention may conveniently comprise mixtures of one or more mineral oils and/or one or more synthetic oils.

The base oil for use herein preferably has a kinematic viscosity at 40° C. (according to ASTM D445) of from 10 to 2000 $mm^2/s$.

Mineral oils include liquid petroleum oils and solvent-treated or acid-treated mineral lubricating oil of the paraffinic, naphthenic, or mixed paraffinic/naphthenic type which may be further refined by hydrofinishing processes and/or dewaxing.

Synthetic oils include hydrocarbon oils such as olefin oligomers (PAOs), dibasic acid esters, polyol esters, polyalkylene glycols and dewaxed waxy raffinate. Synthetic hydrocarbon base oils sold by the Shell Group under the designation "XHVI" (trade mark) may be conveniently used.

Suitable base oils for use in the lubricating oil composition of the present invention are Group I, Group II or Group III base oils, polyalphaolefins, Fischer-Tropsch derived base oils and mixtures thereof.

By "Group I" base oil, "Group II" base oil and "Group III" base oil in the present invention are meant lubricating oil base oils according to the definitions of American Petroleum Institute (API) categories I, II and III. Such API categories are defined in API Publication 1509, 15th Edition, Appendix E, April 2002.

Suitable Fischer-Tropsch derived base oils that may be conveniently used as the base oil in the lubricating oil composition of the present invention are those as for example disclosed in EP 0 776 959, EP 0 668 342, WO 97/21788, WO 00/15736, WO 00/14188, WO 00/14187, WO 00/14183, WO 00/14179, WO 00/08115, WO 99/41332, EP 1 029 029, WO 01/18156 and WO 01/57166.

In a preferred embodiment of the invention, the base oil is that of mineral origin sold by the Royal Dutch/Shell Group of Companies under the designations "HVI" or "MVIN".

The metal base is preferably present at a level in the range of from 1 wt % to 5 wt %, more preferably at a level in the range of from 2 wt % to 4 wt %, by weight of the metal complex grease composition.

There are no particular limitations on the type of metal base which can be used in the process of the present invention. Examples of suitable metal bases for use herein include lithium hydroxide, calcium hydroxide, aluminium hydroxide, titanium hydroxide and mixtures thereof. A preferred metal base for use herein is lithium hydroxide.

In order to prepare a metal complex soap thickener, a complexing agent is added during the manufacturing process. Suitable complexing agents include low to medium molecular weight acids or diacids. Preferred complexing agents for use herein are selected from boric acid, sebacic acid, azelaic acid, benzoic acid, oxalic acid, malonic acid, succinic acid, glutaric acid, adipic acid, suberic acid, pimelic acid, dodecanedioic acid, and mixtures thereof.

A particularly preferred complexing agent for use herein is boric acid.

The slurry prepared in the first step of the process herein comprises water. The weight ratio of water:solids in the slurry is in the range of from 0.15:1 to 1.5:1, preferably in the range of from 0.2:1 to 1:1, more preferably in the range of from 0.2:1 to 0.6:1. It has surprisingly been found that the present process allows relatively low levels of water to be added with corresponding reduction in venting time.

The slurry tank is preferably equipped with an internal mixer and a re-circulation line.

In a second essential step of the process, the slurry is subjected to a shear frequency of at least 1,000,000 $s^{-1}$. The preferred shear frequency herein is at least 1,500,000 $s^{-1}$, more preferably at least 1,800,000 $s^{-1}$, even more preferably at least 2,000,000 $s^{-1}$.

Any mixer suitable for providing a shear frequency of at least 1,000,000 $s^{-1}$ can be used herein.

Applying a shear frequency of at least 1,000,000 $s^{-1}$ to the slurry preferably reduces the particle size of the solids (e.g. lithium base, complexing agent) present in the slurry such that at least 90% of the solid particles have a particle size of at most 50 μm. It is preferred that the particle size of the solids present in the slurry is reduced to an average particle size in the range of from 0.0001 μm to 200 μm, more preferably in the range of from 1 μm to 75 μm, even more preferably in the range of from 3 μm to 50 μm.

The saponification reaction occurs at the water-oil interface. Without wishing to be limited by theory, reducing the particle size to said ranges means that the mass transfer area is increased and less water is needed to effect the saponification and complexation reactions.

In-situ (i.e. located in the slurry vessel itself) or in-line (i.e. located outside the slurry vessel) high shear mixers can be used in the process herein. In-situ high shear mixers are located in the slurry vessel itself while in-line high shear mixers are located outside the slurry vessel, such as on a re-circulation line. In a preferred process herein, an in-line high shear mixer is used wherein the high shear mixer is located on a recirculation line of the slurry vessel.

Suitable mixers for use herein are high shear mixers which preferably comprise at least one screen having square holes, known as a Square Hole High Shear Mixer (SQHSM). In one suitable embodiment, for use herein, the high shear mixer comprises two screens, an inner screen and an outer screen, at least one of which has square holes. It is preferred that the outer screen has square holes. In one embodiment herein the high shear mixer comprises an outer screen having square holes and an inner screen having slotted square holes (i.e. rectangular in shape). It is also possible to have a high shear mixer comprising three screens, preferably wherein at least one of the screens has square holes.

An especially preferred high shear mixer for use herein comprises two screens both having square holes (a Double Screen Square Holes High Shear Mixer).

When a high shear mixer has an inner screen and an outer screen, it is typically the outer screen which provides a shear frequency of at least 1,000,000 $s^{-1}$.

Examples of suitable high shear mixers for use herein are those disclosed in U.S. Pat. No. 3,897,013 and U.S. Pat. No. 3,632,227, preferably fitted with at least one square hole screen, more preferably fitted with two square hole screens.

Suitable high shear mixers for use herein include, but are not necessarily limited to, the following mixers:

(1) a Double Screen Square Holes High Shear Mixer commercially available from Silverson having the Model number 312/450MS, having 4 inner rotor blades, 12 outer rotor blades, a drive speed of 300 RPM, a power rating of 7.5 kW, a frequency of 50 Hz, an inner rotor tip speed of 12.4 m/s, an outer rotor tip speed of 17.95 m/s, an inner shear frequency of 435483 $s^{-1}$ and an outer shear frequency of 2143393 $s^{-1}$;

(2) a Double Screen Square Holes High Shear Mixer commercially available from Silverson having the Model number 450/600MS, having 4 inner rotor blades, 12 outer rotor blades, a drive speed of 300 RPM, a power rating of 15 kW, a frequency of 50 Hz, an inner rotor tip speed of 17.95 m/s, an outer rotor tip speed of 23.95 m/s, an inner shear frequency of 714464 $s^{-1}$ and an outer shear frequency of 3320558 $s^{-1}$.

High Shear Mixers having frequencies other than 50 Hz, e.g. 60 Hz, are also suitable for use herein.

In a third step of the process of the present invention, the slurry emerging from step (ii) is brought into contact with a $C_{10}$-$C_{24}$ saturated or unsaturated fatty acid or derivative thereof to effect a saponification reaction. The saponification reaction is carried out at a temperature of at least 80° C., preferably at least 100° C. As used herein the term "saponification reaction" also includes a complexation reaction. As used herein the term "saponified product" also includes complexed product.

The $C_{10}$-$C_{24}$ saturated or unsaturated fatty acid or derivative thereof can be pre-melted before being brought into contact with the slurry from step (i). Typically the $C_{10}$-$C_{24}$ saturated or unsaturated fatty acid is pre-melted in base oil.

Examples of suitable fatty acid components for use herein include fatty acids, fatty acid esters, fatty glycerides, and combinations thereof. The fatty acid component comprises carbon atoms generally in a range of from 10 carbon atoms to 24 carbon atoms ($C_{10}$-$C_{24}$), preferably in a range of from 15 carbon atoms to 18 carbon atoms ($C_{15}$-$C_{18}$). The fatty acid component may be saturated or unsaturated. Examples of suitable fatty acid components for use herein include oleic acid, palmitic acid, stearic acid, and other carboxylic acids derived from tallow, hydrogenated fish oil, castor oil, wool, grease, and rosin, and combinations thereof. Examples of suitable fatty acid components for preparing a grease composition include hydrogenated castor oil (HCO), hydrogenated castor oil fatty acid (HCOFA), and combinations thereof, preferably hydrogenated castor oil fatty acid (HCOFA). Hydrogenated castor oil (HCO) is the glyceride of 12-hydroxystearic acid. 12-hydroxystearic acid is a preferred fatty acid for use herein.

Hydrogenated castor oil fatty acid (referred to herein as HCOFA) generally comprises at least 85 weight percent of 12-hydroxystearic acid based on the total weight of HCOFA. HCOFA may comprise minor amounts of additional components. Examples of additional components include palmitic acid ($C_{16}$), stearic acid ($C_{18}$), arachidic acid ($C_{20}$), 12-ketostearic acid, and combinations thereof. As used herein, the term "hydrogenated castor oil fatty acid" ("HCOFA") refers to a composition comprising an amount of 12-hydroxystearic acid, generally an amount comprising at least 85 weight percent 12-hydroxystearic acid based on the total weight of HCOFA, preferably an amount comprising in a range of from 85 to 87 weight percent 12-hydroxystearic acid based on the total weight of HCOFA.

In step (iv) of the process, water is removed from the saponified product resulting from step (iii). Preferably, all of the water present in the saponified product emerging from step (iii) is removed in step (iv), i.e. the water which is added during preparation of the slurry, the water which is produced during the saponification reaction and any water which is present in the metal base. Preferably the water is removed by evaporation in a so-called "venting step". Removal of the water is preferably carried out by heating the saponified/complexed product resulting from step (iii) to a temperature of at least 100° C., more preferably at least 110° C.

After the water has been removed in step (iv), the product emerging from step (iv) is subjected to a heating step (v) wherein the product is heated to a temperature of at least 190° C., preferably in the range of from 190 to 230° C., more preferably in the range of from 195 to 225° C., and even more preferably in the range of from 200 to 220° C.

Following the heating step (v), the product is subjected to a cooling step (vi) in order to form a metal complex grease composition. Cooling step (vi) is preferably carried out at a temperature in the range of from 200 to 150, preferably in the range of from 195 to 160, more preferably in the range of 190 to 165° C. The cooling step is preferably carried out in a grease kettle.

In an optional step (vii) of the process, performance additives are added to the metal complex grease composition. Addition of performance additives is preferably carried out in a grease kettle. Various conventional grease additives may be incorporated into the lubricating greases of the present invention, in amounts normally used in this field of application, to impart certain desirable characteristics to the grease, such as oxidation stability, tackiness, extreme pressure properties and corrosion inhibition. Suitable additives include one or more extreme pressure/antiwear agents, for example zinc salts such as zinc dialkyl or diaryl dithiophosphates, borates, substituted thiadiazoles, polymeric nitrogen/phosphorus compounds made, for example, by reacting a dialkoxy amine with a substituted organic phosphate, amine phosphates, sulphurised sperm oils of natural or synthetic origin, sulphurised lard, sulphurised esters, sulphurised fatty acid esters, and similar sulphurised materials, organo-phosphates for example according to the formula $(OR)_3P{=}O$ where R is an alkyl, aryl or aralkyl group, and triphenyl phosphorothionate; one or more overbased metal-containing detergents, such as calcium or magnesium alkyl salicylates or alkylarylsulphonates; one or more ashless dispersant additives, such as reaction products of polyisobutenyl succinic anhydride and an amine or ester; one or more antioxidants, such as hindered phenols or amines, for example phenyl alpha naphthylamine; one or more antirust additives; one or more friction-modifying additives; one or more viscosity-index improving agents; one or more pour point depressing additives; and one or more tackiness agents. Solid materials such as graphite, finely divided molybdenum disulphide, talc, metal powders, calcium carbonates, and various polymers such as polyethylene wax may also be added to impart special properties.

To reduce friction levels, those skilled in the art have largely looked to using organic molybdenum-based formulations, and there are numerous proposals in patent literature of such lubricating compositions.

The present invention will now be described by reference to the following Examples.

EXAMPLES

Example 1

A grease composition having the formulation as shown in Table 1 was prepared using the following preparation method. In a first step, a slurry was prepared by adding base oil (in an amount of 10 wt % of the total base oil), LiOH monohydrate and water to a slurry vessel. The weight ratio of water:solids was approximately 0.2-0.4:1. The slurry was mixed for 20 minutes with an in-line high shear mixer with double screen square holes. The mixer used was a High Shear Mixer with double screen square holes commercially available from Silverson having the Model number 312/450MS, having 4 inner rotor blades, 12 outer rotor blades, a drive speed of 300 RPM, a power rating of 7.5 kW, a frequency of 50 Hz, an inner rotor tip speed of 12.4 m/s, an outer rotor tip speed of 17.95 m/s, an inner shear frequency of 435483 $s^{-1}$ and an outer shear frequency of 2143393 $s^{-1}$. Boric acid and dispersant were added to the slurry, again with high shear mixing. The resulting slurry was transferred to an autoclave containing base oil (in an amount of about 50% wt of the total base oil) and pre-melted 12-hydroxystearic acid. The slurry tank and the high shear mixer recirculation line were flushed twice with base oil and the flushings were transferred to the autoclave.

The autoclave was heated at a pressure of about 4 bar at which time the venting was started. The pressure was maintained at about 4 bar until the temperature reached 195-200° C., at which time the venting was finished. The autoclave was heated up to top temperature about 220° C. and the resulting composition was transferred to a grease kettle for addition of remaining base oil, cooling, addition of performance additives and finishing.

The time taken for each manufacturing step was recorded.

Various properties of the finished grease composition were measured using standard test methods as set out in Table 2.

Comparative Example 1

A lithium complex grease having the formulation set out in Table 1 was prepared using essentially the same preparation method as in Example 1 except that a conventional mixer of the paddle and stirrer type with a low shear rate was used to prepare the slurry. In addition the weight ratio of water:solids was about 1.5:1.

The time taken for each manufacturing step was recorded. Various properties of the finished grease composition were measured using standard test methods as set out in Table 2.

TABLE 1

| Component | Comparative Example 1 (wt %) | Example 1 (wt %) |
|---|---|---|
| Mineral Oil | 72 | 75 |
| HCOFA | 9 | 8 |
| Lithium hydroxide monohydrate | 3 | 2 |
| Boric acid | 3 | 2 |
| Dispersant | 3 | 3 |
| Additive Package | 10 | 10 |

TABLE 2

| Test Method | Units | Comparative Example 1 | Example 1 |
|---|---|---|---|
| Unworked Penetration at 25° C. (ASTM D217) | dmm | 281 | 271 |
| Worked Penetration at 25° C. (ASTM D217) | dmm | 280 | 276 |
| Delta pen (Worked Penetration-Unworked Penetration) (ASTM D217) | dmm | +3 | +5 |
| Dropping Point (ASTM D566) | ° C. | 269 | 258 |
| Delta penetration after 100000 strokes (ASTM D217) | dmm | +20 | +14 |
| Delta penetration after 100000 strokes + 10% water (ASTM D217) | dmm | +24 | +40 |
| Oil separation 18 hours at 40° C. (IP 121) | % m | 0.9 | 0.63 |
| Oil separation7 days at 40° C. (IP 121) | % m | 3.9 | 2.45 |
| EP Timken (ASTM D2509) | 1b | 45 | 45 |
| Copper corrosion 24 hours at 100° C. (ASTM D4048) | | 1a | 1b |
| Water Washout 1 hour at 79° C. (ASTM D1264) | % m | 3.9 | 1.4 |
| 4-ball Weld load (ASTM D2596) | kg | 315 | 250 |
| 4-ball Wear Scar (ASTM D2266) | mm | 0.50 | 0.47 |
| Shell Roll 18 hours at 65° C. (ASTM D1831) | dmm | +38 | +36 |
| Shell Roll 100 hours at 100° C. (ASTM D1831) | dmm | +61 | +82 |
| Emcor Rust Test-Distilled Water (IP 220) | | 0/0 | 0/0 |
| Emcor Rust Test-Salt Water (IP 220) | | 1/1 | 0/0 |
| Oxidation Stability 100 hours at 100° C. (ASTM D942) | kPa | 31 | 34.5 |
| Oxidation Stability 400 hours at 100° C. (ASTM D942) | kPa | 102 | 105.1 |
| Fafnir Fretting (ASTM D4170) | mg | 5.0 | 3.5 |
| Wheel Bearing leakage at 130° C. (ASTM D1263) | | 2.5 | 0.59 |

Results

The batch time for Example 1 was 47 minutes faster than that for Comparative Example 1. This difference in batch time was the result of a faster venting and heating time for Example 1 as a result of less water being required in Example 1. The 47 minutes time saving provides a significant productivity improvement for Example 1 compared with Comparative Example 1. Such a significant productivity improvement cannot be due to any small formulation differences between Comparative Example 1 and Example 1.

There was also a significant energy saving going from Comparative Example 1 to Example 1 as less added water meant less water to evaporate. The manufacture of the grease according to Comparative Example 1 needed the addition of about 170 kg of water per batch. The manufacture of grease according to Example 1 needed only about 30 kg of water. The energy saving provided by 140 kg less water added was about 300,000 kJ per batch.

As can be seen from Table 2, Example 1 exhibits excellent grease characteristics, at least equal to those of Comparative Example 1, in spite of being manufactured with less water than a conventional lithium complex grease. The small differences in physical properties between Comparative Example 1 and Example 1 are well within the normal batch to batch variations found in grease manufacture or the repeatability of the test methods.

What is claimed is:

1. A process for the manufacture of a metal complex grease composition comprising the steps of:

(i) preparing a slurry comprising a base oil, water, a metal base and a complexing agent, wherein the weight ratio of water:solid in the slurry is in the range of from 0.15:1 to 1.5:1;

(ii) applying shear to the slurry at a shear frequency of at least 1,000,000 $s^{-1}$;

(iii) adding the slurry emerging from step (ii) to a $C_{10}$-$C_{24}$ saturated or unsaturated fatty acid or derivative thereof to effect a saponification reaction, the saponification reaction being carried out at a temperature of at least 80° C.;

(iv) removing water from the saponified product resulting from step (iii);

(v) heating the product emerging from step (iv) at a temperature in the range of from 190 to 230° C.; and (vi) cooling the product emerging from step (v) to a temperature in the range of from 200 to 150° C. to form the metal complex grease composition.

2. The process according to claim 1 wherein the weight ratio of water:solid in the slurry is in the range of from 0.2:1 to 1:1.

3. The process according to claim 1 wherein the shear frequency is at least 1,500,000 $s^{-1}$.

4. The process according to claim 1 wherein step (ii) is carried out by a high shear mixer having at least one square holes screen.

5. The process according to claim 4 wherein the high shear mixer comprises two square holes screens.

6. The process according to claim 1 wherein the process comprises an additional step (vii):

(vii) adding performance additives to the metal complex grease composition.

7. The process according to claim 1 wherein the metal base is selected from the group consisting of: lithium hydroxide, calcium hydroxide, aluminium hydroxide, titanium hydroxide and mixtures thereof.

8. The process according to claim 1 wherein the metal base is lithium hydroxide.

9. The process according to claim 1 wherein the complexing agent is selected from the group consisting of: boric acid, sebacic acid, azelaic acid, benzoic acid, oxalic acid, malonic acid, succinic acid, glutaric acid, adipic acid, suberic acid, pimelic acid, dodecanedioic acid, and mixtures thereof.

10. The process according to claim 1 wherein the complexing agent is boric acid.

11. The process according to claim 1 wherein the $C_{10}$-$C_{24}$ saturated or unsaturated fatty acid or derivative thereof is 12-hydroxy stearic acid.

* * * * *